United States Patent [19]

Arnold

[11] 4,103,748

[45] Aug. 1, 1978

[54] METHOD FOR INHIBITING THE WEAR IN A WELL CASING

[76] Inventor: James F. Arnold, 6440 Hillcroft, Houston, Tex. 77081

[21] Appl. No.: 748,889

[22] Filed: Dec. 10, 1976

[51] Int. Cl.[2] ..... E21B 7/04

[52] U.S. Cl. ..... 175/61; 166/255; 166/242

[58] Field of Search ..... 175/61, 45, 73, 78, 175/75, 81, 76, 325, 171; 166/242, 255, 277, 278; 64/2 R, 3; 308/4 A; 285/114

[56] References Cited

U.S. PATENT DOCUMENTS

| | | | |
|---|---|---|---|
| 940,733 | 11/1909 | Sands | 166/242 X |
| 1,446,789 | 2/1923 | Dodd | 166/242 X |
| 2,216,945 | 10/1940 | Hinderliter | 285/114 |
| 2,334,350 | 11/1943 | Neuhaus | 308/4 A X |
| 2,510,386 | 6/1950 | Denning et al. | 175/78 |
| 2,641,444 | 6/1953 | Moon | 175/171 X |
| 2,651,499 | 9/1953 | Zublin | 175/75 |
| 2,706,615 | 4/1955 | Zublin | 64/3 |
| 2,758,818 | 8/1956 | Kammerer, Jr. | 308/4 A X |
| 3,501,173 | 3/1970 | Petersen et al. | 285/114 |

*Primary Examiner*—Ernest R. Purser
*Assistant Examiner*—Richard E. Favreau

[57] ABSTRACT

A method for inhibiting the wear in a well casing is accomplished by determining the depths within a bore hole of a well where a drill string may contact the well casing. The casing is then run into the bore hole with one or more hardened wear sections positioned therein for ultimate landing at the depths where the drill string may contact the casing.

10 Claims, 9 Drawing Figures

METHOD FOR INHIBITING THE WEAR IN A WELL CASING

BACKGROUND AND SUMMARY OF THE INVENTION

This invention relates generally to a method for inhibiting the wear in a well casing, and more particularly, to a method for inhibiting wear during drilling operations.

It is well known in the drilling industry that in those drilling areas where deviation of the bore hole is a problem, abrasive wear may occur in a well casing from a drill string. Continuing abrasive wear may cause a hole to be formed in the casing. A hole in the casing leads to serious problems; such as key seating, mud washouts and the loss of the ability to flexibly control down hole mud weights. A further problem exists when the drill string and hole deviate sharply where the drill string leaves the casing. This sharp deviation permits the drill string to bear against the bottom end of the casing and a slot is cut into the casing shoe. As more trips in and out of the hole occur, additional wear and slotting takes place, which may lead to the tool joints of the drill pipe locking in the slot. The drill string is then prevented from being removed from the hole. A hole or slot in the casing can therefore mean the loss of time, the loss of equipment, the loss of material, the loss of the use of the hole and the substantial loss of money.

One suggested solution to casing holes involves repairing the well casing after it has been holed. This solution involves the use of cement patching and redrilling. However, this solution is time consuming and does not work toward preventing reoccurrence of holes developing at other locations within the casing.

Another suggested solution to eliminate casing holes involves the use of a soft material, such as rubber, to prevent the abrasive wear. The soft material is used as a wear sleeve which is mounted at spaced intervals on the exterior of the drill string or within the casing, as described by A. W. Kammerer, Jr. in U.S. Pat. No. 2,758,818. Sustained contact between the drill string and casing is prevented by these wear sleeves. However, these wear sleeves cause problems by being expensive, wear out quickly and may tend to restrict circulation of the drilling mud.

Accordingly, it is the primary aim of this invention to provide a method for inhibiting the wear in a well casing, which results in savings of time, equipment, material, the continued use of the hole and money.

In accordance with the invention, a method for inhibiting the wear in a well casing is provided. The wear is inhibited by determining the depths within a bore hole of a well where a drill string may contact the well casing. The casing is then run into the bore hole with one or more hardened wear sections positioned within the casing for ultimate landing at the depths where the drill string may contact the casing.

BRIEF DESCRIPTION OF THE DRAWINGS

Other objects and advantages of the invention will become apparent upon reading the following detailed description and upon reference to the drawings, in which.

While the invention will be described in connection with a preferred procedure, it will be understood that it is not intended to limit the invention to that procedure. On the contrary, it is intended to cover all alternatives, modifications and equivalents as may be included within the spirit and scope of the invention as defined by the appended claims.

DETAILED DESCRIPTION OF THE INVENTION

Figure 1:
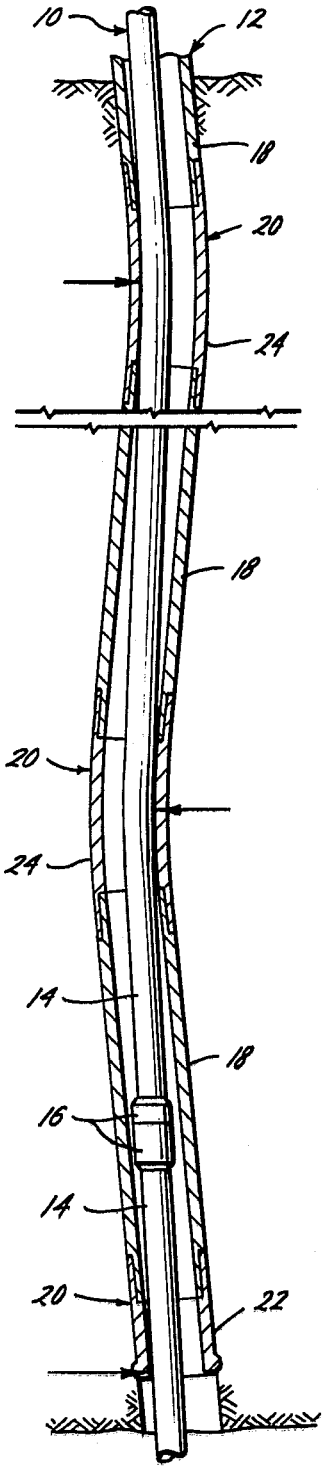
FIG. 1 is an elevational view, partly in section, of an embodiment constructed according to the invention.

Turning first to FIG. 1, there is shown a drill string 10 extending through a well casing 12. Drill string 10 is constructed from drill string joints 14 and tool joints 16 with a drill bit (not shown) connected to the bottom. Drill string 10 is of conventional design and is used to rotate the drill bit. Although drill string 10 is illustrated as being constructed from specific components, it should be understood that drill string 10 may be constructed from any components used in the well drilling industry.

Casing 12 is constructed of conventional casing components, such as double pin ended sections 18 and upset connectors (not shown), and of hardened wear sections 20. Although conventional casing sections 18 are illustrated as double pin ended casing using upset connectors, it should be understood that the present invention is useable in all other casing types. Some examples of these other casing types are round thread API casing, buttress thread casing, extreme line casing and VAM casing.

Wear sections 20 are modified hardened casing shoes 22, hardened wear subs 24, hardened casing heads 33 and hardened casing spools 44. Wear sections 20 are constructed to have the same internal diameter, external diameter and screw threads as the selected conventional casing components. The major difference between wear sections 20 and the equivalent conventional casing components is in the hardness of the interior surface. Preferably, the interior surfaces of wear sections 20 have a hardness at selected wear points of 2 to 3 times harder than the equivalent conventional casing structure.

Different embodiments of hardened wear subs 24 are illustrated in FIGS. 2 to 5. Preferably, the length of hardened wear subs 24 is from 18 inches to 8 feet long.

Figure 2:
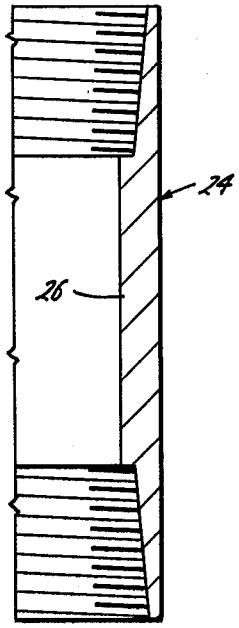
FIG. 2 is a sectional, elevational view of a first embodiment of a first portion of the invention.

As shown in FIG. 2, interior surface 26 of hardened casing sub 24 has been flame hardened, in a conventional manner, to a Rockwell C hardness of between 40 and 50.

Figure 3:
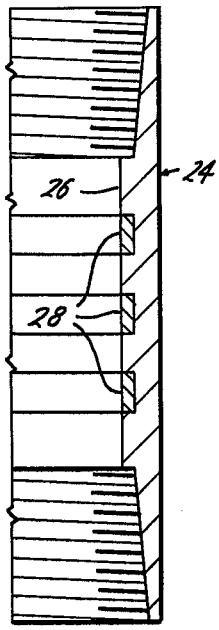
FIG. 3 is a sectional, elevational view of a second embodiment of the first portion of the invention.

As shown in FIG. 3, hard metal inserts 28 are positioned within interior surface 26 of sub 24 to provide the contact surface with respect to drill string 10. Hard metal inserts 28 are preferably constructed from tungsten carbide because of the metal's desirable physical properties.

Figure 4:
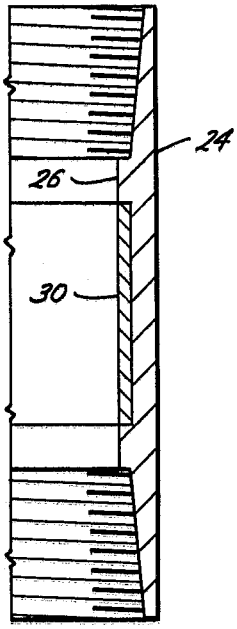
FIG. 4 is a sectional, elevational view of a third embodiment of the first portion of the invention.

As shown in FIG. 4, a single hard metal insert 30 is positioned within interior surface 26 of sub 24 to provide the contact surface with respect to drill string 10. Hard metal insert 30 is preferably constructed from tungsten carbide because of the metal's desirable physical properties.

Figure 5:
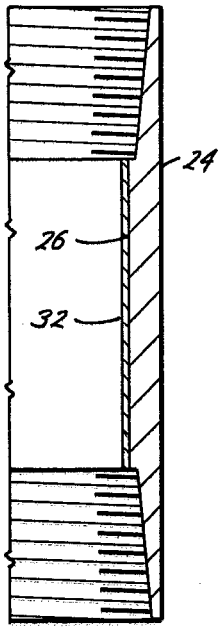
FIG. 5 is a sectional, elevational view of a fourth embodiment of the first portion of the invention.

As shown in FIG. 5, a hard metal sleeve 32 is positioned adjacent and attached to interior surface 26 of sub 24 to provide the contact surface with respect to drill string 10. Hard metal sleeve 32 is preferably constructed from tungsten carbide because of the metal's desirable physical properties.

Figure 6:
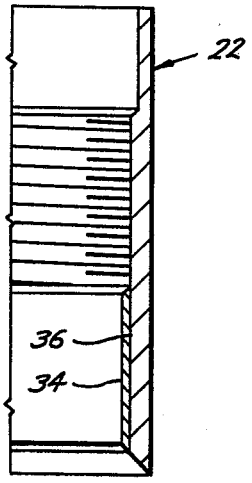
FIG. 6 is a sectional, elevational view of an embodiment of a second portion of the invention.

As shown in FIG. 6, hardened casing shoe 22 is illustrated with a hard metal sleeve 34 positioned adjacent and attached to an interior surface 36 to provide the contact surface with respect to drill string 10. Sleeve 34 is preferably constructed from tungsten carbide because of the metal's desirable physical properties. Although shoe 22 is illustrated having a hard metal sleeve attached to interior surface 36, it should be understood that interior surface 36 can be hardened by flame hardening as explained with respect to the embodiment shown in FIG. 2, by using hard metal inserts as explained with respect to the embodiment shown in FIG. 3 or by using a single hard metal insert as explained with respect to the embodiment shown in FIG. 4.

Figure 7:
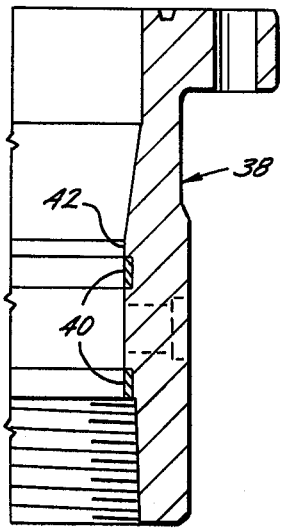
FIG. 7 is a sectional, elevational view of an embodiment of a third portion of the invention.

As shown in FIG. 7, a hardened casing head 38 is illustrated with hard metal inserts 40 positioned within interior surface 42. Inserts 40 are positioned to provide the surface contacting drill string 10. Inserts 40 are preferably constructed from tungsten carbide because of the metal's desirable physical properties. Although casing head 38 is illustrated having inserts 40 positioned within interior surface 42, it should be understood that surface 42 can be hardened by flame hardening as explained with respect to the embodiment shown in FIG. 2, by using a single hard metal insert as explained with respect to the embodiment shown in FIG. 4 or by using a hard metal sleeve as explained with respect to the embodiment shown in FIG. 5.

Figure 8:
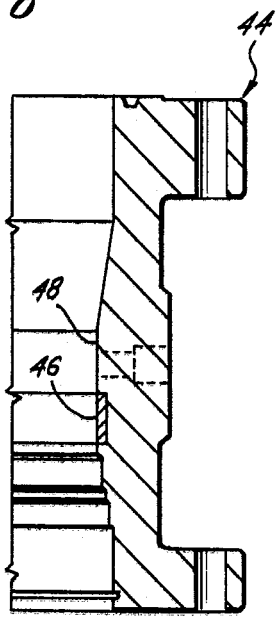
FIG. 8 is a sectional, elevational view of an embodiment of a fourth portion of the invention.

As shown in FIG. 8, a hardened casing spool 44 is illustrated with a single hard metal insert 46 positioned within interior surface 48 to provide the contact surface with respect to drill string 10. Preferably, insert 46 is constructed from tungsten carbide because of the metal's desirable physical properties. Although spool 44 is illustrated with single hard metal insert 46 positioned within interior surface 48, it should be understood that surface 48 can be hardened by flame hardening as explained with respect to the embodiment shown in FIG. 2, by using hard metal inserts as explained with respect to the embodiment shown in FIG. 3 or by using a hard metal sleeve as explained with respect to the embodiment shown in FIG. 5.

Figure 9:
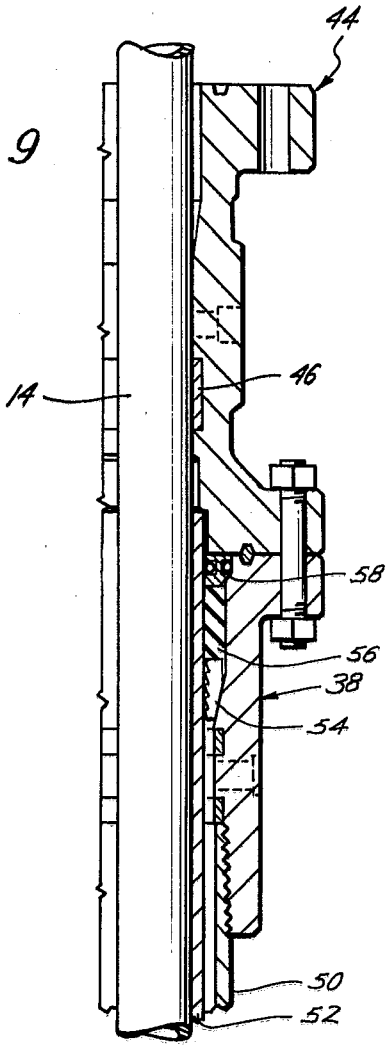
FIG. 9 is an elevational view, partly in section, of an embodiment constructed according to the invention.

As shown in FIG. 9, a casing head 38 or casing spool 44 may be made-up within casing 12 in the event that drill casing 10 will contact casing 12 at the highest point. Also, shown is the use of multiple casing strings as represented by first casing string 50 and second casing string 52. These subsequent casing strings are made-up as described for casing 12 except that casing hanger slip 54, packing 56 and thrusting ring 58 are suitably disposed between first casing string 50 and second casing string 52 to support second casing string 52.

To make casing 12, a hole is drilled into the earth by the bit connected to drill string 10. The bit and drill string 10 are then removed from the earth and the depths in the bore hole are determined where drill string 10 may contact well casing 12. This determination can be reached in any conventional manner; such as, by a dip meter log survey and electrical resistivity log. In the event that drill string 10 will contact casing 12 at the lowest point in casing 12, hardened casing shoe 22 is selected for landing at this lowest point. Successive conventional casing sections 18 and connectors are joined to shoe 22 for running into the bore hole until the next lowest point where drill string 10 will contact casing 12. One or more hardened wear subs 24 are then selected for make-up within casing 12 and joined to casing 12 for running into the hole. Casing 12 continues to be run into the bore hole with hardened wear subs 24 being added to casing 12 for ultimate landing at the determined depths.

First casing string 50 is cemented then cemented in the bore hole and drilling operations continue in a conventional manner. Should subsequent casing strings be needed, the casing strings are made-up as described with respect to casing 12 and supported within first casing string 50 or subsequent casing strings by suitable disposition of casing hanger slips 54, packing 56 and thrust rings 58. The subsequent casing strings may or may not be cemented in; however, the drilling operations continue in a conventional manner to completion of drilling operations.

From the foregoing it will be seen that this invention is one well adapted to attain all the ends and objects hereinabove set forth, together with other advantages which are obvious and which are inherent to the method.

As many possible embodiments may be made of the invention without departing from the scope thereof. It is to be understood that all matter herein set forth or shown in the accompanying drawings is to be interpreted as illustrative and not in a limiting sense.

What is claimed is:

1. A method for inhibiting the wear in a well casing, comprising determining the depths within a bore hole of a well where a drill string may contact the well casing and running the casing into the bore hole with one or more hardened wear sections positioned within the casing for ultimate landing at the depths where the drill string may contact the casing, the wear sections being harder than the remainder of the well casing.

2. The method of claim 1, including selecting one or more of the wear sections for installation in the well casing to be hardened casing subs for ultimate landing at the determined depths above the lowest point of the well casing.

3. A method for inhibiting the wear in a well casing, comprising determining the depths within a bore hole of a well where a drill string may contact the well casing, running the casing into the bore hole with one or more hardened wear sections positioned within the casing for ultimate landing at the depths where the drill string may contact the casing and selecting the wear sections for installation in the well casing to have substantially the same internal diameter as the remainder of the well casing.

4. The method of claim 3, including selecting one of the wear sections for installation in the well casing to be a hardened casing shoe for ultimate landing at the lowest point of the well casing.

5. The method of claim 3, including selecting one of the wear sections for installation in the well casing to be a hardened casing head for ultimate landing at the highest point of the well casing.

6. The method of claim 3, including selecting one of the wear sections for installation in the well casing to be a hardened casing spool for ultimate landing at the highest point of the well casing.

7. The method of claim 3, including selecting one or more of the wear sections for installation in the well casing to be hardened casing subs for ultimate landing at the determined depths above the lowest point of the well casing.

8. The method of claim 3, including selecting the hardened wear sections to have hard metal inserts with the inserts facing the interior of the well casing.

9. The method of claim 8, wherein the hard metal inserts are selected to have substantially the same physical properties as tungsten carbide.

10. A method for inhibiting the wear in a well casing, comprising determining the depths within a bore hole of a well where a rotary drilling string may excessively rub against the well casing after the latter is installed in the well, selecting a hardened casing shoe and one or more hardened wear subs, the hardened wear subs having hard metal inserts facing the interior of the well casing with substantially the same internal diameter as the remainder of the well casing, the hard metal inserts having substantially the same physical properties as tungsten carbide, installing the selected shoe in the lower end of the casing for ultimate landing at the lowest point of the well casing, and installing the selected wear subs as a part of the casing as the casing is lowered into the hole at points along the length such that upon landing, the wear subs in the casing will be at the depths determined as above, whereby the hardened casing shoe and wear subs form an integral part of the well casing for preventing wear in the casing caused by rubbing of the string against the casing at the determined depths during subsequent drilling operations.

* * * * *